United States Patent [19]

Pickles

[11] 4,229,906

[45] Oct. 28, 1980

[54] WINDOW REGULATOR

[75] Inventor: Joseph Pickles, Birmingham, Mich.

[73] Assignee: Ferro Manufacturing Corporation, Detroit, Mich.

[21] Appl. No.: 930,376

[22] Filed: Aug. 2, 1978

[51] Int. Cl.[3] ..... E05F 11/48

[52] U.S. Cl. ..... 49/352; 74/89.2

[58] Field of Search ..... 49/352; 74/89.2

[56] References Cited

U.S. PATENT DOCUMENTS

| | | | |
|---|---|---|---|
| 1,274,471 | 8/1918 | Todd | 49/352 X |
| 1,627,697 | 5/1927 | Fredericks | 49/352 |
| 4,004,371 | 1/1977 | Podolan et al. | 49/352 |
| 4,168,595 | 9/1979 | Pickles et al. | 49/352 |

FOREIGN PATENT DOCUMENTS

| | | | |
|---|---|---|---|
| 2441010 | 3/1975 | Fed. Rep. of Germany | 49/352 |
| 2532458 | 2/1977 | Fed. Rep. of Germany | 49/352 |
| 570342 | 7/1945 | United Kingdom | 49/352 |
| 1209622 | 10/1970 | United Kingdom | 49/352 |
| 1407082 | 9/1975 | United Kingdom | 49/352 |

*Primary Examiner*—Robert Mackey

*Attorney, Agent, or Firm*—Whittemore, Hulbert & Belknap

[57] ABSTRACT

A window regulator for moving a vehicle window vertically between closed and open positions, in which the window is housed within the vehicle door when in opened position. The mechanism comprises a drum and an elongated element having only sufficient flexibility to permit it to conform to the outer surface of the rotatable drum, an elongated functionally rigid track extending from the drum, the flexible element and track being cooperatively shaped such that the said element is slidable longitudinally on said track in guided relation. One end of the flexible element is fixed to the drum and the other has a bracket secured thereto which in turn is attached to the bottom edge of the vehicle window. Means are provided for rotating the drum in opposite directions to raise and lower the window. The invention is more broadly mechanism for converting motion between linear and rotary modes.

6 Claims, 14 Drawing Figures

64
62a
74
66
76
70a
14
48
46a
42
24
22
43
40
44
46
69
56
41
60
78
70
62
80
50
41a
72
68
58

WINDOW REGULATOR

BRIEF SUMMARY OF THE INVENTION

The present invention has as its primary purpose the control movement of a vehicle window between an open or lower position in which the window is usually housed within a hollow door, and an upper or closed position in which the window closes the window area above the door.

In order to effect vertical movement of the window, there is provided in the upper portion of the space within the vertical door a rotary drum of substantial diameter as for example in excess of six inches. Suitable means are provided for rotating the drum and these means preferably comprise internal teeth on the drum and pinion in mesh with the teeth.

Associated with the drum and adapted to be wound thereon and unwound therefrom from the rotation of the drum is an elongated element having only sufficient flexibility to permit its ready winding and unwinding on the drum. The drum is mounted in a housing which includes a flange portion spaced radially from the drum to provide a radially enclosed annular space confining the flexible element therein. The flange is omitted for a limited circumferential distance to provide a window through which the flexible element is longitudinally movable as it is wound and unwound on the drum.

It will be seen that when the drum is rotated in a direction to push the elongated element through the window, buckling of the element is prevented by the enclosing flange portion.

Extending laterally of the drum housing and more particularly from the aforementioned window there is provided an elongated guide member along which the flexible element is slidable. The guide member and the element are cooperatively formed so that the flexible element is limited to longitudinal sliding movement with respect to the guide member.

The guide member is formed so that a bracket secured to the free outer end of the flexible element is slidable along the guide member. This bracket is attached to the window and the guide member is disposed generally vertically so that as the drum is rotated the window is moved vertically.

The present invention was devised for the actuating of a vehicle window. It is of course apparent that it may have other uses wherever it is desirable to convert rotary movement to longitudinal movement or vice versa.

It will further be noted that while the guide member may be rectilinear, it may also be given some transverse curvature so that the structure secured to the free end of the flexible element may have generally linear motion which, however, may depart from simple straight line movement.

In the application of the mechanism to a window regulator, the pinion which drives the drum may of course be manually rotated as for example a crank or it may be motor driven.

DETAILED DESCRIPTION

Figure 2:
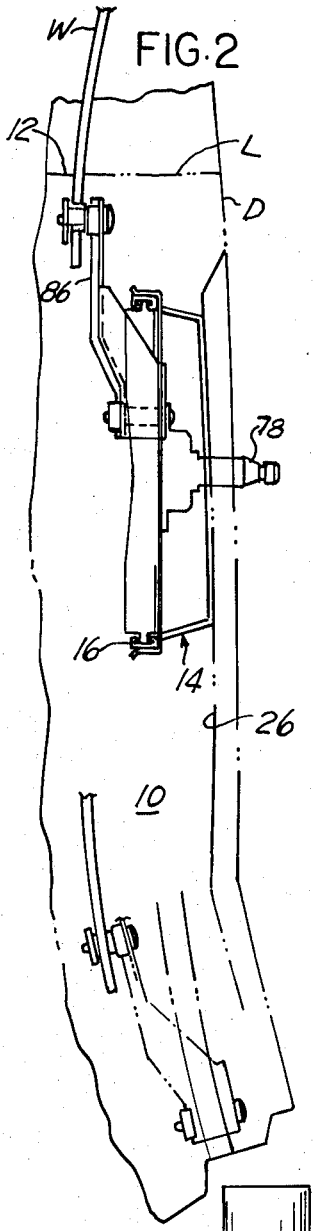
FIG. 2 is a side elevational view of the mechanism seen in FIG. 1.

Referring now to the drawings, there is indicated generally at D a vehicle door having an interior hollow portion 10 below a ledge L having an opening 12 through which the window W is vertically movable. It will be understood that the window is slidable in vertical edge guides.

Figures 3, 5, 13, 14:
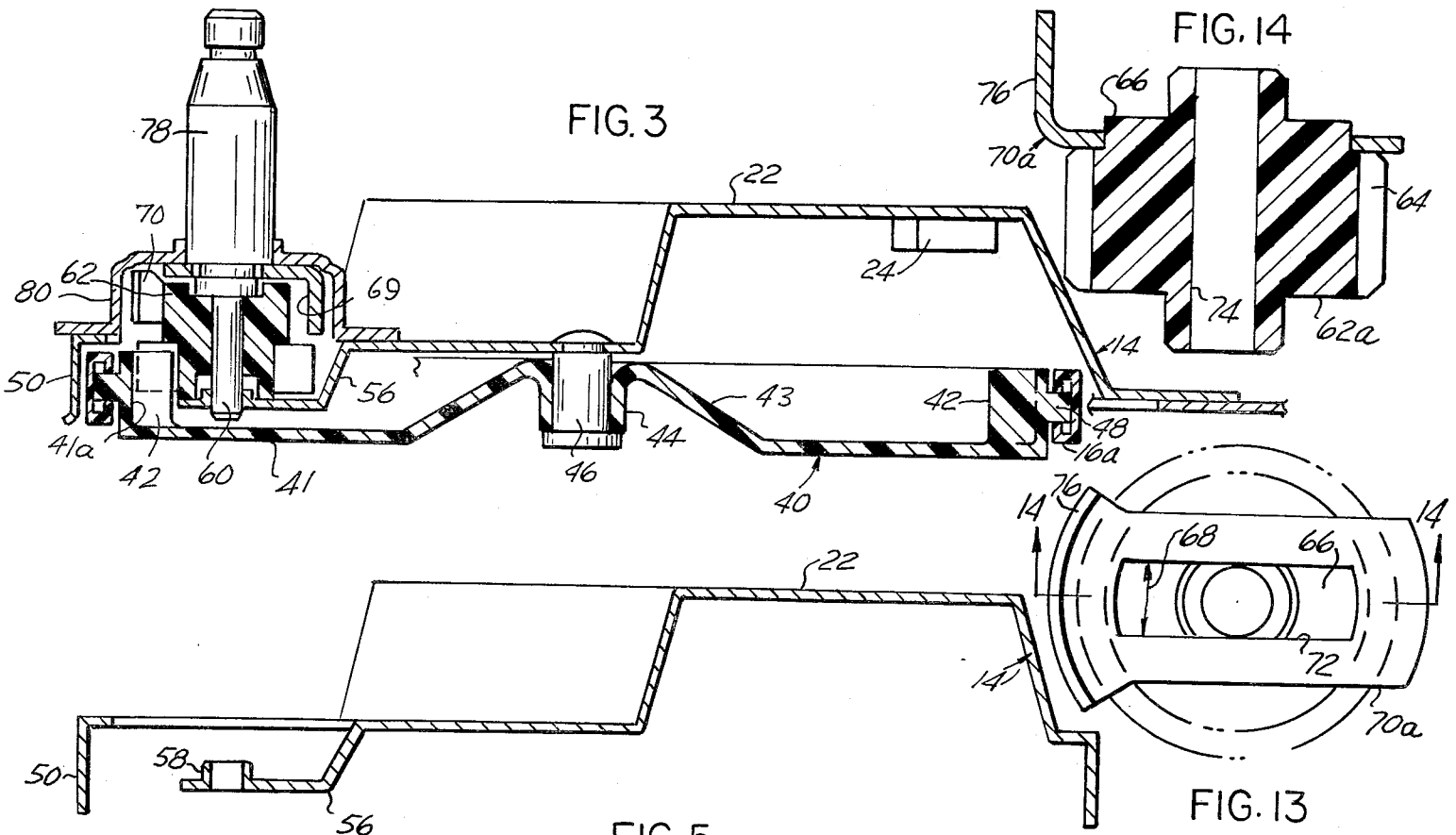
FIG. 3 is an enlarged sectional view taken on the line 3—3, FIG. 1.
FIG. 5 is a sectional view taken on the line 5—5 through the drum housing.
FIG. 13 is an enlarged elevational view showing a subassembly of a modified plastic pinion and metal coupler.
FIG. 14 is a sectional view on the line 14—14, FIG. 13.

Housed within the hollow interior 10 of the door D is the window regulating mechanism comprising essentially a drum support housing 14, and an elongated element 16 having only sufficient flexibility to permit it to conform to the peripheral surface of the drum. Extending laterally from the drum housing is an arm 18 to which the upper end of a substantially rigid but preferably slightly bendable elongated linear guide member 20 is attached. The drum housing 14 as best illustrated in FIG. 3 includes a raised portion 22 having openings therethrough in registry with welded nuts 24 by means of which the drum housing and attached mechanism may be mounted to supporting structure 26 within the door D.

Figure 8:
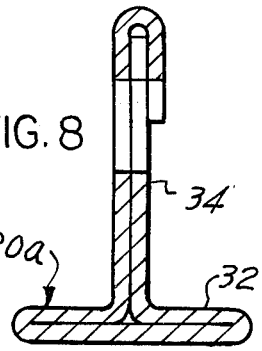
FIG. 8 is an enlarged sectional view on the line 8—8, FIG. 6.
Figure 10:
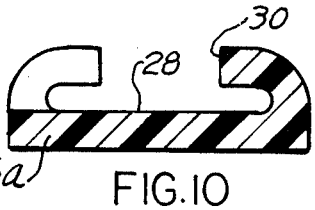
FIG. 10 is an enlarged sectional view on the line 10—10, FIG. 9.
Figure 9:
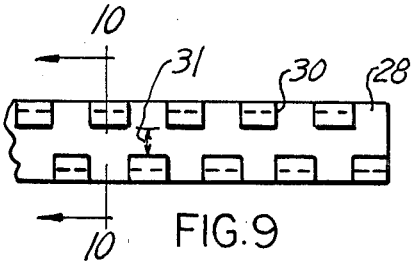
FIG. 9 is a fragmentary elevational view of the flexible element.

Referring now to FIGS. 6 through 11, there is illustrated a form of elongated flexible element here designated **16*a* and the linear guide here designated 20*a*. An element and guide of this type is disclosed in my copending prior application, Ser. No. 850,556, filed Nov. 11, 1977, now U.S. Pat. No. 4,168,595. The elongated flexible element 16*a* includes a flat tape or belt portion 28 having along opposite edges laterally and then inwardly extending tabs or tangs 30. As best seen in FIG. 9, the tabs 30 are spaced apart longitudinally of the element a distance substantially equal to the width of the tabs and the tabs at the opposite sides of the tape portion 28 are staggered. With this arrangement, it will be observed that at one side of the flexible element, as viewed in FIG. 9, there is a longitudinally extending narrow groove or channel 31 which not only provides clearance for the stem 34 of the support T-shaped but also positions the flexible element properly on the periphery of the drum as will subsequently appear. It will be apparent in FIG. 10** that, at the section illustrated in this figure, the tab at the right hand side of the element is in section whereas the tab at the left hand side is seen in elevation.

The material of the flexible element is a suitable plastic material such for example as an acetal polymer. The flat or tape portion of this element is dimensioned so that the element has only sufficient flexibility in a direction perpendicular to its width so as to permit it to conform readily to the outer periphery of the drum. In a specific example, the flat tape portion of the element has a width of approximately a half inch and a thickness a mounting to only a minor fraction of its width. This flexible element is made of any suitable plastic material, of which acetal polymer is only an example, and of course exhibits substantially complete rigidity with references to forces applied edgewise. Its thickness, however, permits it to conform readily to the outer periphery of the drum.

The elongated generally rigid guide 20*a*, as best illustrated in FIG. 8, is formed of sheet metal bent into a generally T-shaped transverse configuration. As seen in this figure, the head or cross member of the T here designated 32 is connected to the stem 34 of the T, these portions being formed of double thickness of the metal as shown. Adjacent one end of the guide 20*a*, the stem is provided with a multiplicity of bolt holes for a purpose which will presently appear.

The elongated guide 20*a*, due to its configuration, is substantially rigid in use but it will be understood that when being shaped into the illustrated condition, it may be given a slightly transverse curvature in any direction so that in fact the window bracket which is guided vertically along the guide may be caused to traverse a curved path and to suitably incline the bracket to cause the window to conform to its required path. Thus for example in modern windows, the window often moves upwardly and slightly inwardly along a curved path.

Figure 11:
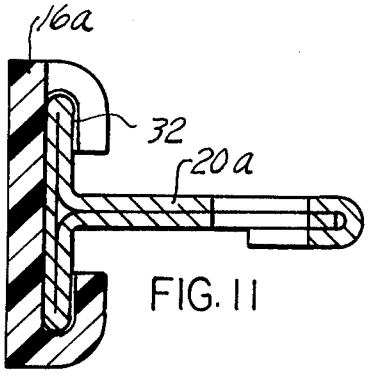
FIG. 11 is a sectional view showing the flexible element in association with the elongated linear guide.
Figure 7:
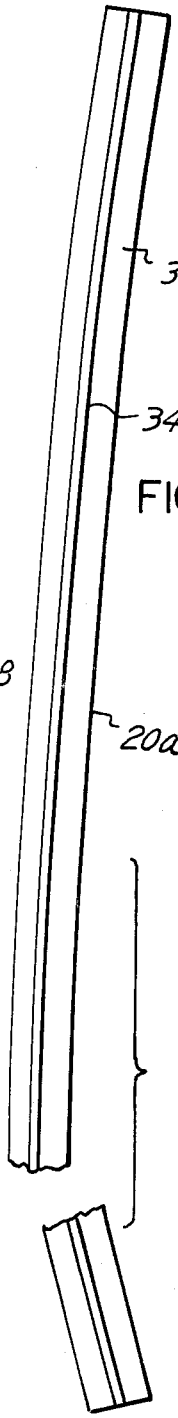
FIG. 7 is a side view of the member shown in FIG. 6.

Referring now to FIG. 11, it will be seen that the flexible element 16*a* is freely slidable along the head 32 of the guide 20*a*.

Accordingly, as the drum is rotated to draw the flexible element upwardly and to wind it around the drum, the lower end of the flexible element and the bracket secured thereto is freely movable along the functionally rigid guide 20*a*. Similarly, when the drum is rotated in the opposite direction so that the flexible element is pushed onto the guide, the tabs 30 in association with the head 32 of the T shape of the guide ensure that the flexible element is limited to a longitudinally sliding motion with respect to the guide 20*a*.

Figure 4:
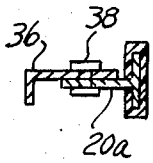
FIG. 4 is an enlarged sectional view taken on the line 4—4, FIG. 1.

It will be understood that the T shaped elongated guide 20 is fixedly mounted in the required position by mounting brackets indicated at 36 in FIG. 4 to which the guide is bolted as indicated at 38.

Referring now to FIGS. 3 and 5, the drum 40 is formed of plastic material as illustrated, and comprises a generally circular flat peripheral portion 41 having at its periphery an axially extending annular flange 41*a*, the inside of which is in the form of an internal gear having teeth 42. The central portion 43 of the drum extends laterally from the plane of the flat portion 41 in the same direction as the annular flange 41*a*, and is formed with a tubular hub 44 which extends therefrom in a direction opposite to that in which the annular flange 41*a* extends. The flange 41*a* and the hub 44 are substantially axially coextensive. The support housing 14 has a central mounting pin 46 which extends therefrom in the same direction as hub 44 extends from drum 40. The drum is mounted for rotation on the pin 46. The outer surface of the annular flange 41*a* of the drum 42 is provided with a narrow circular guide flange 48 dimensioned to be received in the longitudinal groove 31 of the flexible element 16*a*. This, of course, guidingly positions the element 16*a* on the drum which is important as the flexible element moves between the drum and the elongated guide 20.

Moreover, since the flexible element 16*a* has appreciable flexibility in a direction transverse to its width, it is necessary to confine the flexible element between the drum and an outer circumscribing surface so as to prevent outward bulging or displacement of the flexible element as the drum rotates in a direction which pushes the flexible element onto the guide member. This surface is illustrated in FIG. 5 as provided by a circular housing flange 50 which however is discontinuous in an area located generally at 52 so as to provide a window through which the flexible element may pass out of the drum housing onto the flexible guide 20.

Figure 6:
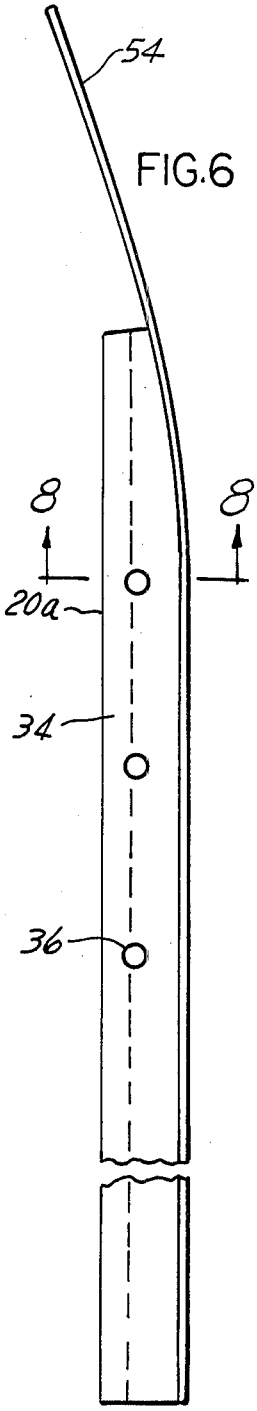
FIG. 6 is an elevational view of the guide member.

It will be observed in FIG. 6 that the guide 20*a* includes an extension 54 which extends beyond the step portion 34 of the guide to intercept the flexible element as it is fed off the drum onto the guide.

The drum housing 14, as best illustrated in FIG. 5, includes a struck out position 56 formed to provide a bushing 58 which receives a pin 60.

Pin 60 is connected to drive pinion 62 which meshes with the internal teeth 42 of the drum 40. Also rigidly connected to the drive pin and the external drive connections 78 is a metal drive element 69 which is adapted to engage and drive a coupler 70 fixed to the pinion 62.

Referring now to FIGS. 13 and 14, there is illustrated a somewhat modified pinion 62*a* having external teeth 64 dimensioned to cooperate with the internal teeth 42 on the drum. The pinion 62*a* is formed of a suitable plastic material such, for example, as an acetal polymer and provides an exceptionally quiet running condition with the internal gear. Since the pinion 62*a* is formed of a plastic material lacking the strength characteristics of metal, the pinion is provided with an elongated integral radially extending drive flange or key 66 which extends substantially across one end of the pinion, the flange having a narrow dimension as indicated at 68. Associated with the pinion is a metallic coupler 70 *a* having an opening 72 dimensioned to receive the flange 66 and to impart a drive torque thereto which would be impossible through the relatively small opening 74 which receives the pin 60. The coupler 70 includes a drive flange 76 which is engageable by suitable drive means such for example as a driving projection on the drive member 78 which in turn is connected to the pin 60. Obviously the drive member 78, which is shown in FIG. 2 as extending to the interior of the door for connection with a crank, may, if preferred, be omitted, and coupler 70 connected to an electric motor housed within the door cavity 10.

A cup 80 is provided at the exterior of the drum housing 14 as best illustrated in FIG. 3 to provide means for enclosing the pinion 62 or 62*a* and to support the rotary drive structure such as coupler 70 or 70*a*.

Figure 12:
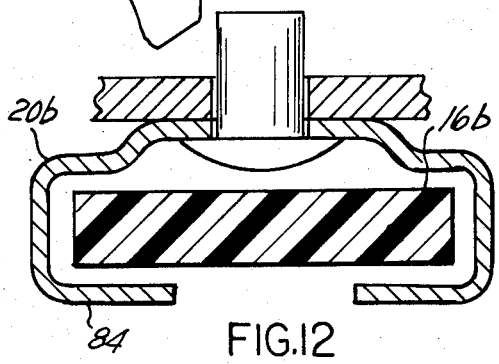
FIG. 12 is a sectional view similar to FIG. 11 showing the use of a differently shaped flexible element and guide.

Referring now to FIG. 12, there is illustrated a further embodiment of the present invention which differs only in detail construction of the flexible element 16 and the guide 20. In this figure, the flexible element here designated 16*b* is in the form of an elongated strap or belt of rectangular cross section suitably dimensioned to have only sufficient flexibility transversely of its width to permit it to conform to the outer periphery of the drum. Element 16*b* is preferably formed of a plastic material such as a suitable acetal polymer. The elongated guide 20*b* which receives the flexible element for longitudinally sliding movement is generally in the form of a partially enclosed channel having spaced apart flanges 84. The spaced apart flanges 84 leave a channel therebetween in which the flexible element 16*b* is exposed, so that a window bracket attached to the lower end of the flexible element 16*b* may move longitudinally of the guide member.

Figure 1:
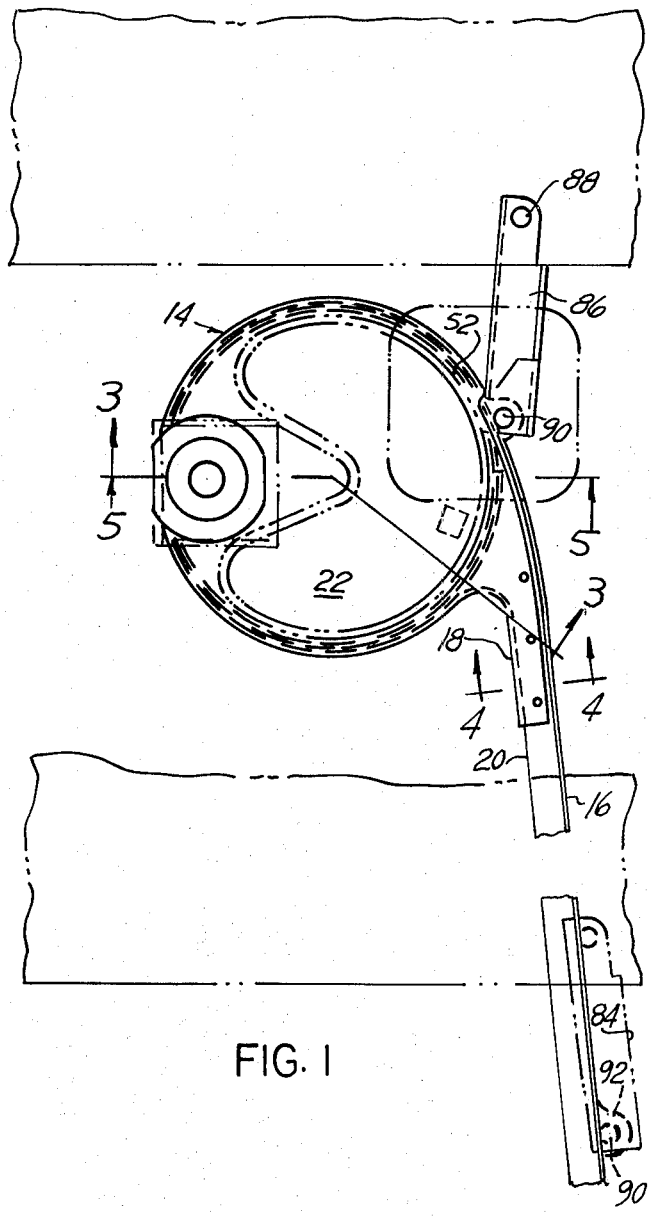
FIG. 1 is a fragmentary elevational view partly diagrammatical, showing the window regulating mechanism.

Referring now to FIGS. 1 and 2, it will be observed that the window W is movable between the lower position illustrated in which a bracket 86 may move from the full line position illustrated at the top of the figures, in which the window W is closed, to the lowermost position in which the upper edge of the window is retracted within the opening 12 in the window ledge L. It will be observed in FIG. 1 that the bracket 86 in its upper limiting position has moved into a position substantially adjacent the drum housing window location 52. It will also be observed in this figure that the bracket 86 changes its angularity with respect to the elongated flexible element 16 and with respect to the window W, this movement of the bracket being permitted by a pivot connection 88 with the window and a pivot connection 90 to a projection 92 attached directly to the flexible element 16.

What is claimed is:

1. A window regulator comprising a circular drum having a flat peripheral portion having an annular flange extending axially from one side of said drum, the central portion of said drum extending laterally from its flat peripheral portion in the same direction as said annular flange, and a central tubular hub extending axially from said central portion of said drum in a direction opposite to that in which said flange extends, said annular flange and hub being generally axially coextensive, the inner surface of said annular flange having a circular array of gear teeth thereon, the outer surface of said annular flange having a narrow guide flange extending raidally outwardly therefrom, a generally circular support housing having a drum supporting pin fixed centrally thereon and extending in the same direction from said support housing as said hub, said drum being mounted by its hub for rotation on said pin, said support housing having a circular housing flange extending therefrom in the same direction as said pin, said housing flange being spaced radially outwardly from said guide flange to define an annular confining space therewith, a pinion pivotally mounted on said support housing between said drum and support housing and in mesh with the gear teeth on the annular flange of said drum, an elongated, slightly flexible window actuating element having in cross-section a flat tape portion and laterally and then inwardly extending tangs spaced apart to define a central guide groove therebetween, said element being wound on the outer surface of said drum with said guide flange extending into the space between said tangs, one end of said element being fixed to said drum, said housing flange being discontinuous to define a window through which flexible element extends, an elongated functionally rigid support on which the portion of said element exterior of said support housing is slidable having one end fixed to said support housing adjacent said window, a bracket on said flexible element for attachment to a vehicle window, and means for rotating said pinion to drive said drum in opposite directions to move said bracket longitudinally of said support.

2. A window regulator as defined in claim 1, in which the slightly flexible element is formed of a plastic material.

3. A window regulator as defined in claim 1, in which said support housing has a partially cut-out portion adjacent its periphery bent toward said drum to leave an opening in the support housing, a cup over the opening formed by the bent portion, and a pin extending between said cup and bent portion on which said pinion is mounted.

4. A window regulator as defined in claim 1, in which said drum is formed of a plastic material.

5. A window regulator as defined in claim 1, in which said pinion is formed of a plastic material, said pinion having an integral drive key extending substantially across one end thereof, and a metal drive plate having an elongated slot in which said key is received, said drive plate having a lateral extension, said means for rotating said pinion comprising rotatable means engageable with said extension.

6. A window regulator comprising a circular drum integrally formed of plastic material and having a peripheral cylindrical flange and a central tubular hub concentric with said cylindrical flange, an intermediate portion of said drum connecting said flange to said hub comprising a conical portion, said cylindrical flange extending laterally from the periphery of said intermediate portion in one direction, said tubular hub extending laterally from said intermediate portion in the opposite direction, so that said conical portion constitutes a reinforcement between said cylindrical flange and said hub, said cylindrical flange and hub being generally axially coextensive, the inner surface of said annular flange having a circular array of gear teeth thereon, the outer surface of said annular flange having a narrow guide flange extending radially outwardly therefrom, a generally circular support housing having a drum supporting pin fixed centrally thereon and extending in the same direction from said support housing as said hub, said drum being mounted by its hub for rotation on said pin, said support housing having a circular housing flange extending therefrom in the same direction as said pin, said housing flange being spaced radially outwardly from said guide flange to define an annular confining space therewith, a pinion pivotally mounted on said support housing between said drum and support housing and in mesh with the gear teeth on the annular flange of said drum, an elongated, slightly flexible window actuating element having in cross-section a flat tape portion and laterally and then inwardly extending tangs spaced apart to define a central guide groove therebetween, said element being wound on the outer surface of said drum with said guide flange extending into the space between said tangs, one end of said element being fixed to said drum, said housing flange being discontinuous to define a window through which flexible element extends, an elongated functionally rigid support on which the portion of said element exterior of said support housing is slidable having one end fixed to said support housing adjacent said window, a bracket on said flexible element for attachment to a vehicle window, and means from rotating said pinion to drive said drum in opposite directions to move said bracket longitudinally of said support.

* * * * *